US011114254B2

(12) United States Patent
Chen et al.

(10) Patent No.: US 11,114,254 B2
(45) Date of Patent: Sep. 7, 2021

(54) SILVER-GRAPHENE TUNGSTEN MATERIAL ELECTRICAL CONTACT TIPS OF A LOW VOLTAGE CIRCUIT BREAKER

(71) Applicant: Siemens Industry, Inc., Alpharetta, GA (US)

(72) Inventors: Hai Chen, Duluth, GA (US); Jesus Hernandez, Suwanee, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 16/785,086

(22) Filed: Feb. 7, 2020

(65) Prior Publication Data

US 2021/0249199 A1 Aug. 12, 2021

(51) Int. Cl.
*H01H 1/02* (2006.01)
*H01H 1/023* (2006.01)

(52) U.S. Cl.
CPC ..... *H01H 1/023* (2013.01); *H01H 2201/03* (2013.01)

(58) Field of Classification Search
CPC ..... H01H 1/023; H01H 2201/03; B22F 7/00; B22F 9/18
USPC ..... 200/262; 419/11
See application file for complete search history.

(56) References Cited

U.S. PATENT DOCUMENTS

2011/0256014 A1* 10/2011 Hong ..... C22C 26/00 419/11
2015/0069020 A1* 3/2015 Steinwandel ..... H01H 11/048 218/146

OTHER PUBLICATIONS

Wang et al., In-situ Synthesized Silver-graphene Nanocomposite with enhanced electrical and mechanical properties, 2017, IEEE, pp. 225-228.*
Pengpeng Wang et. al / "In-situ synthesized silver-graphene nanocomposite with enhanced electrical and mechanical properties," 2017 IEEE Holm Conference on Electrical Contacts, Denver, CO, 2017, pp. 225-228.

* cited by examiner

*Primary Examiner* — Edwin A. Leon
*Assistant Examiner* — Iman Malakooti

(57) ABSTRACT

A circuit breaker including at least two contact tip that comprise an electrical contact material comprising silver (Ag) and tungsten (W). The contact tip further comprises a graphene material (Gr) additively mixed in Ag as being denoted as AgGr0.3% or AgGr0.5% which is mixed with tungsten (W) to form (AgGr0.3)W50 or (AgGr0.5)W50 called a silver-graphene tungsten composite material.

15 Claims, 9 Drawing Sheets

(a) AgW50

(b) AgGr0.3W50

(c) AgGr0.5W50

(a) AgW50

(b) AgGr0.3W50

(c) AgGr0.5W50

(a) AgGr (b) AgGr0.3W50

(c) AgGr0.5W50

SILVER-GRAPHENE TUNGSTEN MATERIAL ELECTRICAL CONTACT TIPS OF A LOW VOLTAGE CIRCUIT BREAKER

BACKGROUND

1. Field

Aspects of the present invention generally relate to silver-graphene tungsten material electrical contact tips of a low voltage circuit breaker.

2. Description of the Related Art

Conventional electrical contact materials are silver based refractory composite. They are widely applied in low voltage circuit breakers and switches and must withstand arc erosion, contact interface resistance, and resist welding. The challenges of the electrical contact materials are focused on various formulas and their percentages in weight to optimize and balance their properties to meet multiple applications. The typical compositions of Ag base refractory contacts are most commonly paired with W, WC, Mo, C powder metal and with CdO, SnO2, NiO, ZnO metal oxide particles.

Silver tungsten composite material is widely applied in low voltage circuit breakers. AgW50 is a typical composite material, comprised of 50% silver and 50% tungsten in weight. Despite its wide use in low voltage molded case circuit breakers, it still has its challenges when it comes to breaker performance in regard to arcing erosion, welding, and contact resistance.

Therefore, there is a need for electrical contact materials that improve conventional electrical contact material performance in arcing erosion and arcing energy.

SUMMARY

Briefly described, aspects of the present invention relate to silver-graphene tungsten material electrical contact tips of a low voltage circuit breaker. Two different percentage of graphene materials as additively mixed in AgW50 electrical contact material to form (AgGr0.3)W50 and (AgGr0.5)W50 to improve conventional electrical contact material performance in arcing erosion and arcing energy. (AgGr)W50 exhibited a total mass loss of 3.8% which is the lowest of all tested. Functional testing has shown that arcing energy was reduced by 27.1% and 7.4% when testing at 5 kA and 65 kA respectively as compared to AgW50 material. Metallurgical analysis shows that a unique 2-D graphene structure has been observed from the fractography SEM images of silver-graphene tungsten contacts, which is inherited by (AgGr) composite material.

Furthermore (AgGr)W50 microstructure images present great uniform mixing while tungsten distributes in the silver-graphene matrix in comparison with traditional silver tungsten material. Utilizing a PM process, silver-graphene-tungsten (AgGr0.3)W50 and (AgGr0.5)W50 contact tips were successfully produced. The PM process (press, sinter, and re-press) is the same process that is used to make AgW50 contact tips.

In accordance with one illustrative embodiment of the present invention, a contact tip of a circuit breaker is provided. The contact tip comprises an electrical contact material comprising silver-graphene (AgGr) with a graphene material (Gr) in a range of 0.1% to 1.0% additively mixed in Ag as being denoted as AgGr0.3% (Ag 99.7% and Gr0.3% in weight) which is mixed with tungsten (W) to form (AgGr0.3)W50 ((AgGr0.3)50% and W50% in weight) called a silver-graphene tungsten composite material.

In accordance with one illustrative embodiment of the present invention, a contact tip of a circuit breaker is provided. The contact tip comprises an electrical contact material comprising silver (Ag) and tungsten (W) and a graphene material (Gr) in a range of 0.1% to 1.0% additively mixed in Ag as being denoted as AgGr0.5% (Ag 99.5% and Gr 0.5% in weight) which is mixed with tungsten (W) to form (AgGr0.5)W50 ((AgGr0.5) 50% and W50% in weight) called a silver-graphene tungsten composite material.

In accordance with one illustrative embodiment of the present invention, a circuit breaker comprises a first contact tip and a second contact tip. The first contact tip comprises a first electrical contact material comprising silver (Ag) and tungsten (W) and a first graphene material (Gr) having a range of 0.3% to 0.5% additively mixed in Ag with silver to form (AgGr)50W50 called a first silver-graphene tungsten composite material. The second contact tip comprises a second electrical contact material comprising silver (Ag) and tungsten (W) and a second graphene material (Gr) having a range of 0.3% to 0.5% additively mixed in Ag with silver to form (AgGr)50W50 called a second silver-graphene tungsten composite material.

DETAILED DESCRIPTION

Figure 1:
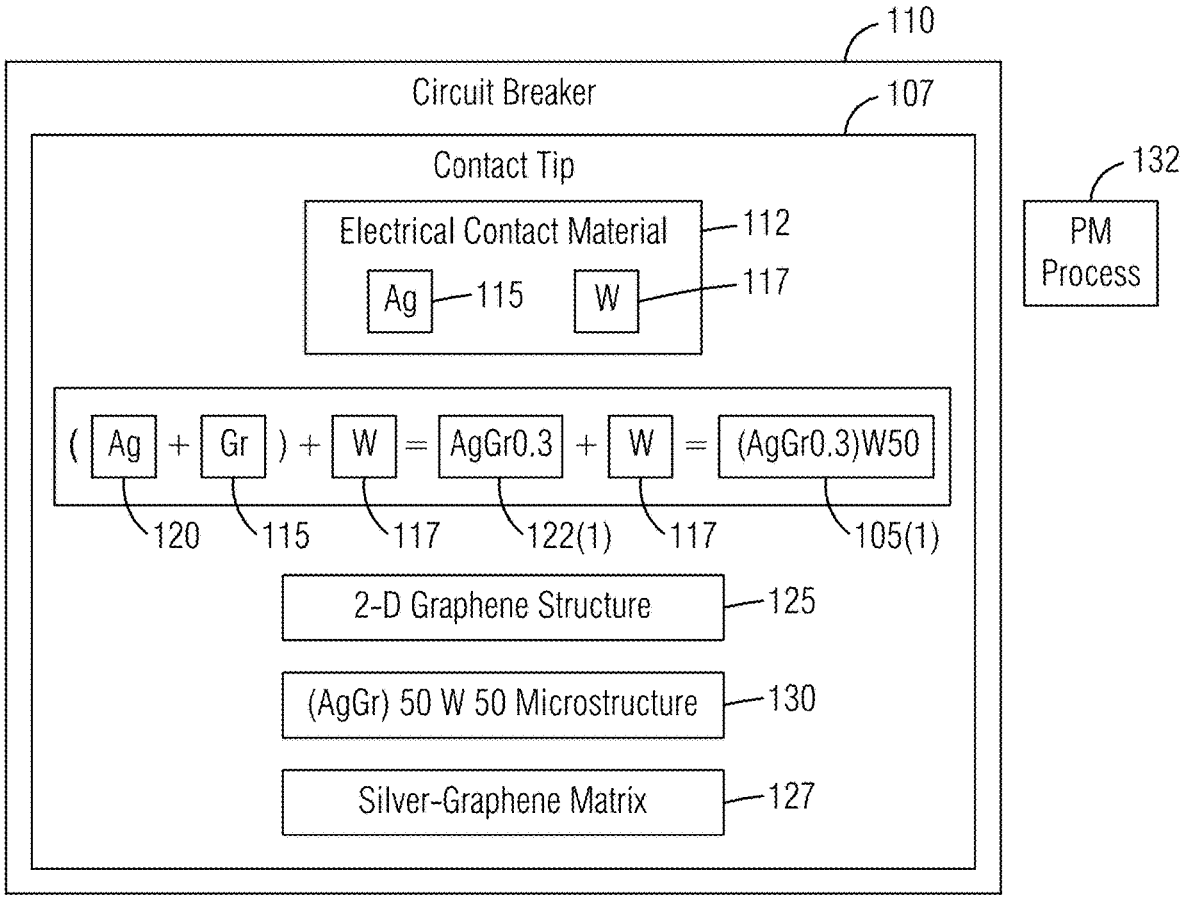
FIG. 1 illustrates a silver-graphene tungsten composite material (AgGr0.3)W50 for a contact tip of a circuit breaker in accordance with an exemplary embodiment of the present invention.

To facilitate an understanding of embodiments, principles, and features of the present invention, they are explained hereinafter with reference to implementation in illustrative embodiments. In particular, they are described in the context of electrical contact materials that improve conventional electrical contact material performance in arcing erosion and arcing energy. A new composition material of silver-graphene, (AgGr) has been introduced. Its powder is produced chemically with Ag salt particles in-situ synthesized with graphene oxide (GO) through by chemically reduction in an aqueous solution. After hydrogen reduction, the powder form of (AgGr) is produced. Conventional Powder Metallurgy (PM) techniques and hot-extruding are employed to prepare (AgGr) composite contact material. The metallic analysis depicts a 2-D carbon matrix where graphene is uniformly coated with silver particles. The extremely high modulus and strength of the 2-D carbon material is an advantage. This composition of materials has been successfully tested in low power switches and relays showing better performance in terms of endurance and durability due to its higher hardness, better mechanical properties as well as better electrical properties. However, silver-graphene can't be applied in low voltage products directly in this form because the melting temperature is similar to the Ag contact material. Testing in our applications in low voltage circuit breakers have been unsuccessful with (AgGr). Up to this point silver refractory metals have been the choice for arcing contact materials use in high fault current applications. These applications include low voltage molded case circuit breaker for residential and industrial applications. In response to this, a novel powder (AgGr) was created to form an advanced silver-graphene composite refractory material when combined with tungsten. Utilizing the PM process, silver-graphene-tungsten (AgGr0.3)W50 and (AgGr0.5)W50 contact tips were successfully produced. The PM process (press, sinter, and re-press) is the same process to make AgW50 contact tips. The microstructure and SEM images from fractography indicate the composite does not only inherit the characteristics of the conventional composite materials but also retains advanced characteristics of silver-graphene composite material. The composite materials of these two electric contact tips are silver-graphene bases, denoted as AgGr0.3% (Ag 99.7% and Gr0.3% in weight) and AgGr0.5% (Ag 99.5% and Gr 0.5% in weigh and mix with tungsten to form (AgGr0.3)W50 ((AgGr0.3) 50% and W50% in weight) and (AgGr0.5)W50 ((AgGr0.5) 50% and W50% in weight). This invention examines properties, microstructures of cross-section, SEM images and preliminary test results including erosion life and standard electrical tests test in comparison with the conventional material AgW50 (Ag 50% and W50% in weight). Please note the brackets applied above is to explain the components of composite material and its percentage in weight. For clarity we omit the brackets, but it does not reflect any change in the composite material defined above. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

These and other embodiments of the silver-graphene tungsten material electrical contact tips of a low voltage circuit breaker according to the present disclosure are described below with reference to FIGS. 1-9 herein. Like reference numerals used in the drawings identify similar or identical elements throughout the several views. The drawings are not necessarily drawn to scale.

Consistent with one embodiment of the present invention, FIG. 1 represents a silver-graphene tungsten composite material (AgGr0.3)W50 105(1) for a contact tip 107 of a circuit breaker 110 in accordance with an exemplary embodiment of the present invention. The contact tip 107 comprises an electrical contact material 112 comprising silver (Ag) 115 and tungsten (W) 117. The contact tip 107 further comprises a graphene material (Gr) 120 in a range of 0.1% to 1.0% additively mixed in the Ag 115 as being denoted as AgGr0.3% (Ag 99.7% and Gr0.3% in weight) 122(1) which is mixed with the tungsten (W) 117 to form the (AgGr0.3)W50 ((AgGr0.3)50% and W50% in weight) 105 (1) called a silver-graphene tungsten composite material. AgW has a variation of percentages such as AgW30, AgW60, AgW75 instead of AgW50. AgGr can be replaced with different electrical contact materials such as AgC, AgWC, AgMo, AgNi, AgCu, AgCdO, AgSnO, AgNiO, and AgZnO.

A unique 2-D graphene structure 125 has been inherited by a silver-graphene composite material (AgGr). A (AgGr) 50W50 microstructure 130 has uniform mixing while tungsten (W) 117 distributes in a silver-graphene matrix 127. The contact tip 107 is produced utilizing a PM process 132 (press, sinter, and re-press). A (AgGr)50W50 based contact tip structure exhibited a total mass loss of 3.8% in a testing process. Arcing energy was reduced by 27.1% and 7.4% when testing at 5 kA and 65 kA respectively in a functional testing process.

Figure 2:
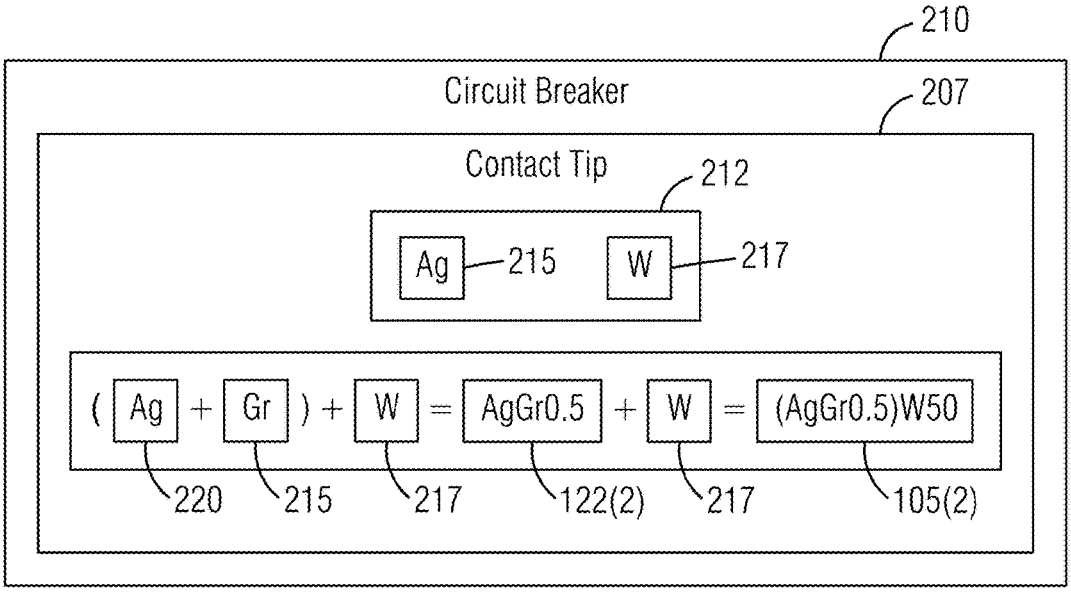
FIG. 2 illustrates a silver-graphene tungsten composite material (AgGr0.5)W50 for a contact tip of a circuit breaker in accordance with an exemplary embodiment of the present invention.

Referring to FIG. 2, it illustrates a silver-graphene tungsten composite material (AgGr0.5)W50 105(2) for a contact tip 207 of a circuit breaker 210 in accordance with an exemplary embodiment of the present invention. The contact tip 207 comprises an electrical contact material 212 comprising silver (Ag) 215 and tungsten (W) 217. The contact tip 207 further comprises a graphene material (Gr) 220 in a range of 0.1% to 1.0% additively mixed in the Ag 215 as being denoted as AgGr0.5% (Ag 99.5% and Gr0.5% in weight) 122(2) which is mixed with the tungsten (W) 217 to form the (AgGr0.5)W50 ((AgGr0.5)50% and W50% in weight) 105(2) called a silver-graphene tungsten composite material.

Two silver-graphene tungsten refractory composite materials, AgGr0.3W50 and AgGr0.5W50 have been described. Both materials have been examined in mechanical and electrical properties in comparison with conventional material AgW50. To better understand the novel materials, the metallurgical analysis explored their unique structure. Initial functional testing programs were conducted. Also, an additional erosion life test was completed and reported the percentage of mass loss. The results can be summarized as following.

The silver-graphene tungsten, AgGr0.3W50 and AgGr0.5W50 composite materials have shown their higher hardness while their resistivities and densities remain the same as with AgW50. The hardness increase has resulted in less percentage of mass loss during the erosion life test. Silver-graphene tungsten has been produced by a PM process successfully and the technology could be extended to the other popular composite materials, such as AgWC, AgC, CdO, $SnO_2$, and NiO with graphene additive. 2-D graphene has dramatically improved silver-graphene composite material properties. The metallurgical analysis has been verified that silver-graphene tungsten composite materials also inherited 2-D graphene characteristics. The relative lower arcing energy has been reported by the test with AgGr0.5W50 material during high and low short circuit interruption, endurance, and the erosion life test. It will improve the performance in welding resistance, arcing erosion, and short circuit interruption.

Graphene (Gr) is a 2D carbon material that has been recognized by its excellent higher hardness and strength properties. The hardness difference between three composite materials, AgW50, AgGr0.3W50, and AgGr0.5W50 is measured by Vickers HV scale. The control material has Ag powder without graphene while the other two have Ag with graphene at 0.3 and 0.5% of weight respectively. The mean value of hardness of AgW50 is 161.6 HV while Ag50Gr0.3W50 and AgGr0.5W50 are 181.34 HV and 195.7 HV respectively. The increased mean hardness value is about 12% with AgGr0.3W50 and 21% with AgGr0.5W50 in comparison with AgW50. Meanwhile, there is no overlap of intervals between AgW50 and AgGrW50, which distinguishes the effect of graphene. Higher hardness of silver graphene materials with values up to 75 HV has been reported. Silver-graphene have much higher hardness than that of most particle-reinforced Ag contact materials. Therefore, the high strength and modulus of mechanical properties of silver-graphene should be inherited in AgGr0.3W50 and AgGr0.5W50 as well.

The measured resistivities of AgW50, AgGr0.3W50, and AgGr0.5W50 of all three materials are almost identical. Silver-graphene exhibits a very low resistivity of 1.6 μΩcm compared the much higher resistivity of tungsten which may explain the similarity of the contact material resistivities. Like the resistivity, the densities of all three materials are very similar. The small percentage by weight of the graphene additive has a negligible effect on the density.

Figure 3:
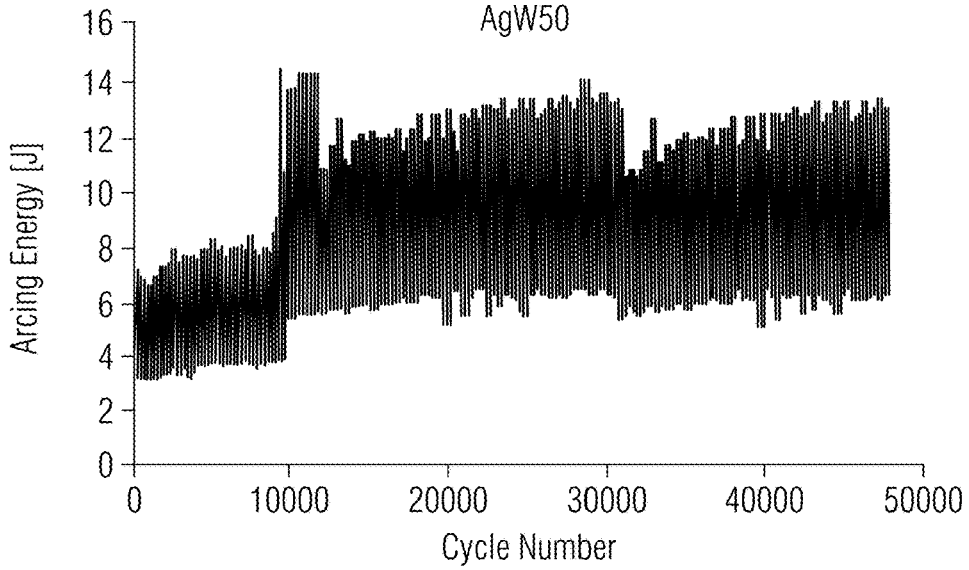
FIG. 3 depicts an individual arcing energy chart for silver tungsten material.
Figure 4:
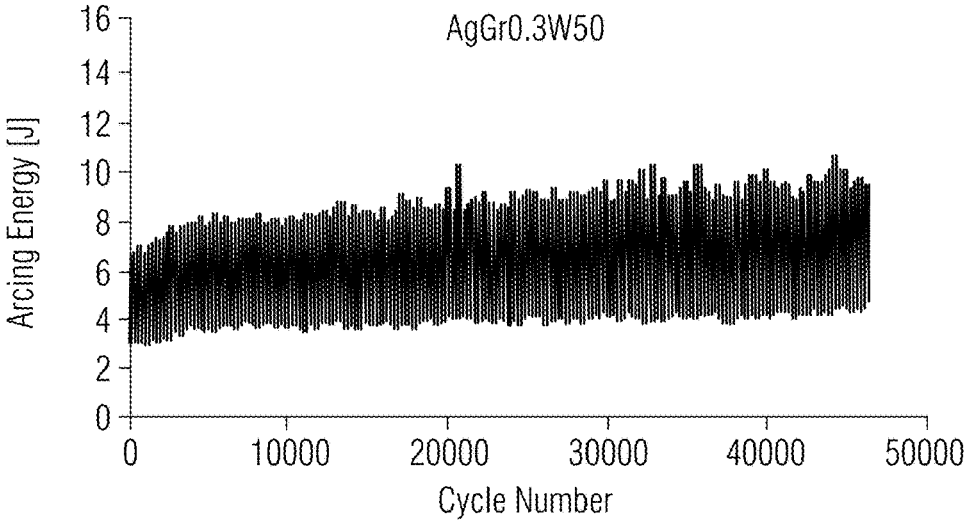
FIG. 4 depicts an individual arcing energy chart for a first silver-graphene tungsten composite material in accordance with an exemplary embodiment of the present invention.
Figure 5:
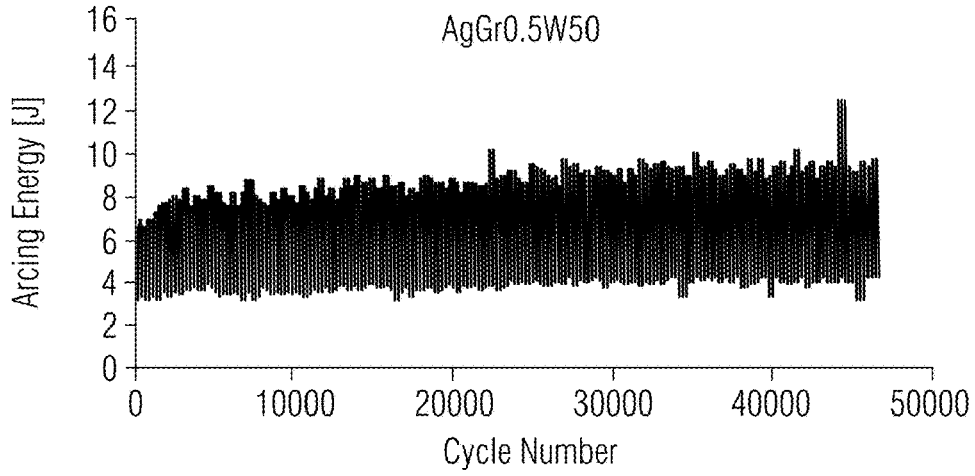
FIG. 5 depicts an individual arcing energy chart for a second silver-graphene tungsten composite material in accordance with an exemplary embodiment of the present invention.

Turning now to FIG. 3, it depicts an individual arcing energy chart for silver tungsten material. FIG. 4 depicts an individual arcing energy chart for a first silver-graphene tungsten composite material in accordance with an exemplary embodiment of the present invention. As seen in FIG. 5, it depicts an individual arcing energy chart for a second silver-graphene tungsten composite material in accordance with an exemplary embodiment of the present invention.

The interesting properties of silver-graphene tungsten had a direct effect on erosion over the life of the contact. An available ON and OFF operating equipment was setup to run 50,000-cycling operations with a circuit of 20 A and 220V AC to evaluate the performance of AgW50, AgGr0.3W50 and AgGr0.5W50 composite materials. All testing parameters are summarized in the Table 1. The arcing energy data was collected during the cycling testing and plotted in FIGS. 3-5.

TABLE 1

| Experimental Condition | |
|---|---|
| Load form | Resistive Load |
| Voltage | AC 220 V |
| Current | 20 A |
| Pressure | 2N |
| Breaking Frequency | 1 Hz |
| Cycle time | 50,000 |

A tester as an electrical contact operating system includes a power bank in the cabinets and an analog device standing on the cabinet. The testing samples include movable contact and static contacts, which are both (05 mm×1.32 mm) from the electrical contact samples prepared for functional test in the following report. For this test, the contact material system was symmetric with both sides being made from the same material. Both contacts were soldered to "T" shape copper posts and then mounted the copper posts on the tester.

FIGS. 3-5 depict three individual arcing energy charts for three different materials undertaken the same task. Silver-graphene tungsten composite materials in FIGS. 4 and 5 resulted in less arcing energy than silver tungsten material in FIG. 3. From the three materials, AgGr0.5W50 takes the lowest arcing energy. The trend of arcing energy increased during the operations. There was no difference in arcing energy for all materials during the operations from 0 to 1,000. AgW50 increased about 50% in arcing energy while AgGrW50 increased only about 10% from 1,000 to 3,000 operations and so on. The arcing energy of silver-graphene tungsten materials are gradually increased while AgW50's grew with three stepwise increase. It is a positive sign that silver-graphene tungsten has a relatively lower arcing energy in general.

Figure 6:
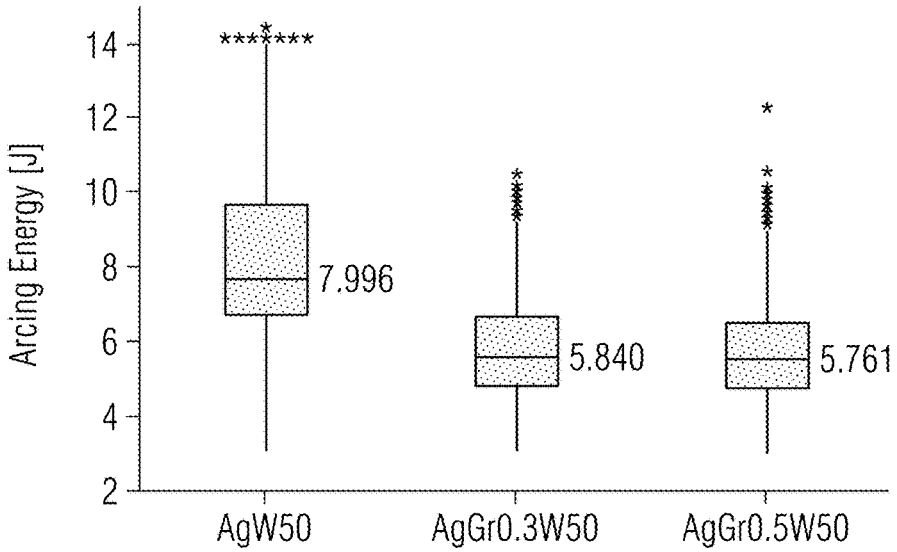
FIG. 6 depicts a box plot as a comparison of ranges of the arcing energy during 50,000 operations in accordance with an exemplary embodiment of the present invention.

Based on statistical analysis, as shown in FIG. 6, a box plot depicts a comparison of the ranges of the arcing energy during 50,000 operations. The median values of arcing energy of silver-graphene tungsten have at least 27% less arcing energy in comparison with silver tungsten in the erosion life test. It is one of the improvements in arcing erosion.

Figure 7:
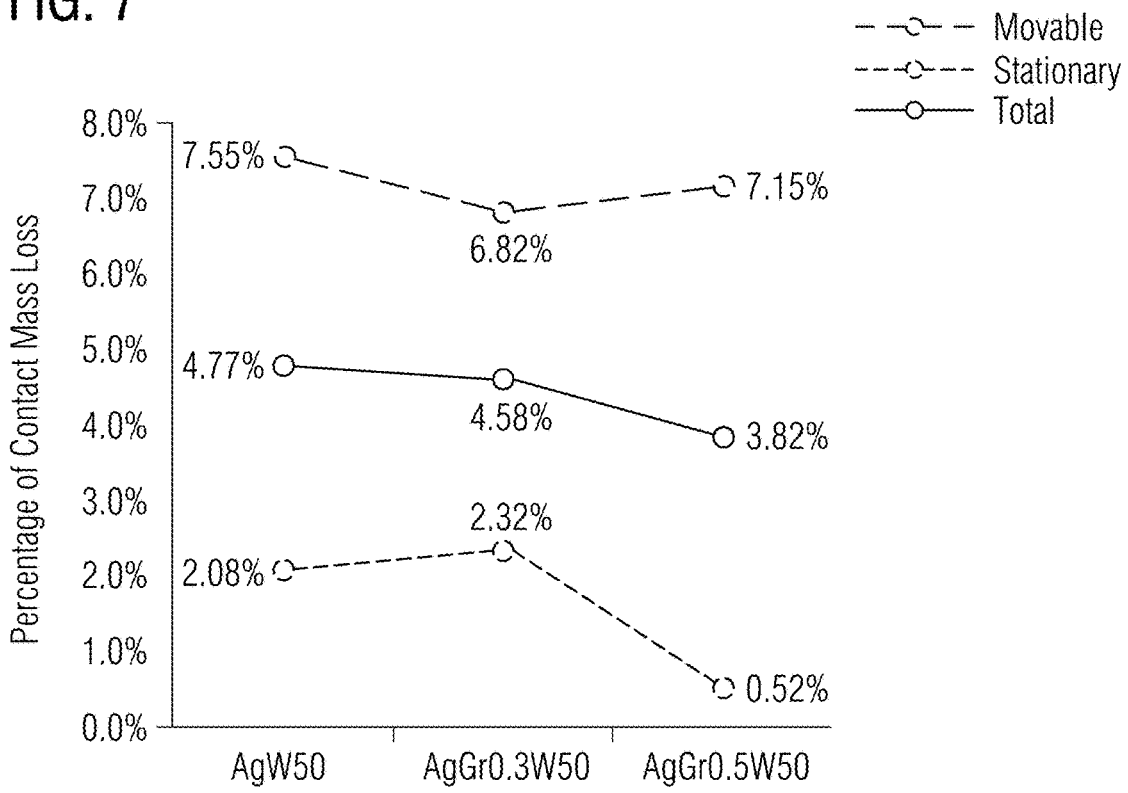
FIG. 7 shows average percentages of the mass loss of movable and stationary contact individually as well as total mass loss (including movable and stationary contacts) after 50,000 operations in accordance with an exemplary embodiment of the present invention.

In FIG. 7, it shows the average percentages of the mass loss of movable and stationary contact individually as well as total mass loss (including movable and stationary contacts) after 50,000 operations. Each operation includes breaking and closing process under 20 A/220V load. The percentage of total mass loss was reduced while the percentage of graphene content was increased. AgGr0.5 W50 had lowest percentage of total mass loss at 3.82%. The percentages of mass loss from individual movable and stationary contacts did not follow the trend of the percentages of the total mass loss. It could be due to measuring error and low sample size. Also, it could be total mass loss of silver-graphene tungsten in FIG. 7 were correlated to lower arcing energy in FIG. 6.

To evaluate the performance of the silver-graphene tungsten composite materials based on the standard criteria, only two materials, AgW50 and AgGr0.5W50 are selected for these programs in order to reduce the tasks. A circuit breaker rated 100 A, 3 pole, plug-in type was selected to conduct all testing. The movable and stationary electrical contacts with the geometries (7.58 mm×5.08 mm×1.97 mm) and (9.59 mm×6.03 mm×1.32 mm) respectively are installed in these breakers. The contact system for all samples use one of conventional arrangement or material symmetric system. Four basic testing programs were planned in the matrix of Table 2.

TABLE 2

Testing programs and their descriptions

| Testing Program | AgW50 | AgGr0.5W50 |
|---|---|---|
| A-seq | 600 A/240 V | 600 A/240 V |
| B-seq | 100 A/240 V | 100 A/240 V |
| C-seq | 5 kA/240 V | 5 kA/240 V |
| D-seq | 65 kA/240 V | 65 kA/240 V |

First row of Table 2 is A-seq with six times rated overload test and then examine 100% rated temperature rise at 40° C. ambient after 50 ON and OFF operations. Second row is B-seq endurance test that includes 6,000 ON and OFF operations with 100 amps loaded and then 4,000 ON and OFF operations without load. Third row is C-seq with multiple 5 kA 240V short circuits, and last row is multiple high interruption current (HIC) ability test, D-seq at 65 kA 240V short circuits. Each testing program includes three samples of the same size as the minimum population.

A-seq results indicate the median temperature rise measured on the connectors from end to end of the samples were 40° C. for the AgW50 contact material and 41° C. for the AgGr0.5W50 material. All three samples with contact material of AgGr0.5W50 passed the B-seq test described in Table 2. In comparison with the samples with AgW50 only partially passed the tests. Silver-graphene tungsten material contributed to the successful testing due to its higher mechanical hardness property and its strength and durability.

AgGr0.5W50 composite material also has shown its better interruption performance in Table 3.

TABLE 3

AgGr0.5W50 contacts short circuit interruption data in comparison with AgW50 in percentage reduction

| Testing Program | Duration [s] | I peak [kA] | $I^2t$ |
|---|---|---|---|
| C-seq | 7.4% | 14.7% | 27.1% |
| D-seq | −1.24% | 1.02% | 7.41% |

Testing with equivalent closing angles in C-seq, the samples with AgGr0.5W50 material resulted in a reduction of over 27.1% Pt in comparison with the samples with AgW50. This result not only shows its excellent interruption capability but also reduces arcing erosion and welding probability. This result may explain how the 2-D graphene structure matrix aids to preserve the composite structure together during interruption.

Data of D-seq in Table 3 has presented a small Pt reduction with 7.41%. However, it is inconclusive given the limited sample size. The percentage differences in duration and peak current are smaller and could be statistically equal in performance. For the duration the average time has slightly increased for silver-graphene tungsten. A larger testing sample may confirm if there is any difference for HIC testing for these materials.

After producing AgGr0.3W50 and AgGr0.5W50 contact tips by PM process as well as AgW50 as a control samples, three groups of the samples were subject to metallurgical analysis. The samples were cut and polished and then examined using an optical microscope to obtain microstructure photos. Three microstructures of the cross-section of the silver-graphene tungsten and silver tungsten are presented in FIGS. 8-10. The white color represents silver and the grey color is tungsten while 2-D graphene can't not be seen in these photos. 2-D graphene will be presented in FIGS. 11-13.

Figure 8:
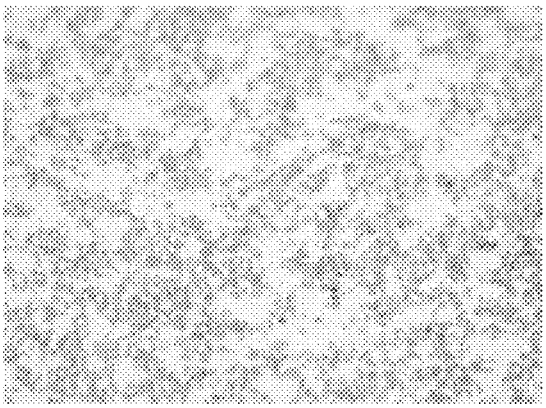
FIGS. 8-10 present three microstructures of the cross-section of the silver-graphene tungsten and silver tungsten in accordance with an exemplary embodiment of the present invention.
Figure 9:
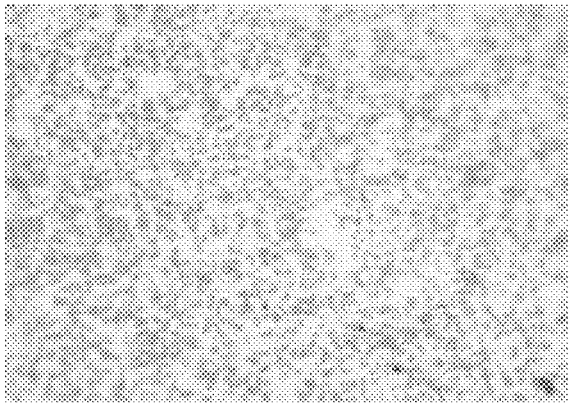
Figure 10:
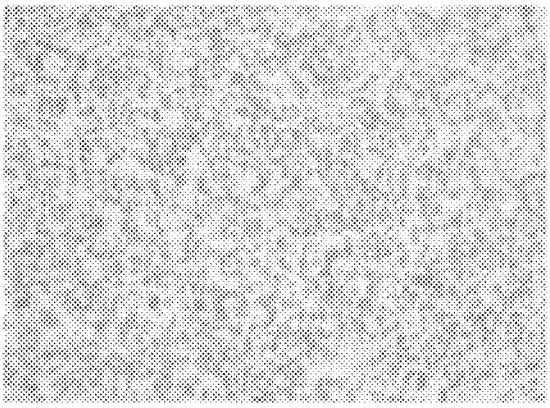

The microstructure images of silver tungsten in FIG. 8 vs. silver-graphene tungsten in FIGS. 9 and 10 differ significantly from the visualization, but not quantitatively. First the tungsten distributions in FIGS. 9 and 10 are similar and their tungsten particles are very uniform in silver matrix. Unlike the silver-graphene tungsten material, AgW50 has some visible silver random lumps and some possible voids in FIG. 8, which is concerned potentially in welding, arcing erosion, and short circuit interruption in applications.

Figure 11:
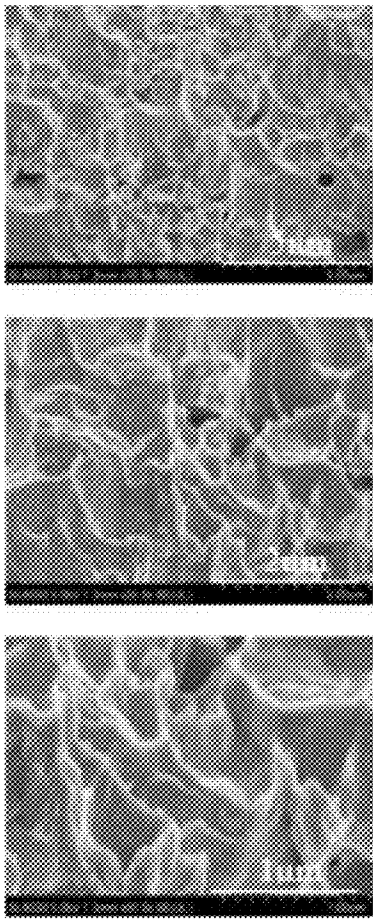
FIGS. 11-13 present 2-D graphene in accordance with an exemplary embodiment of the present invention.
Figure 12:
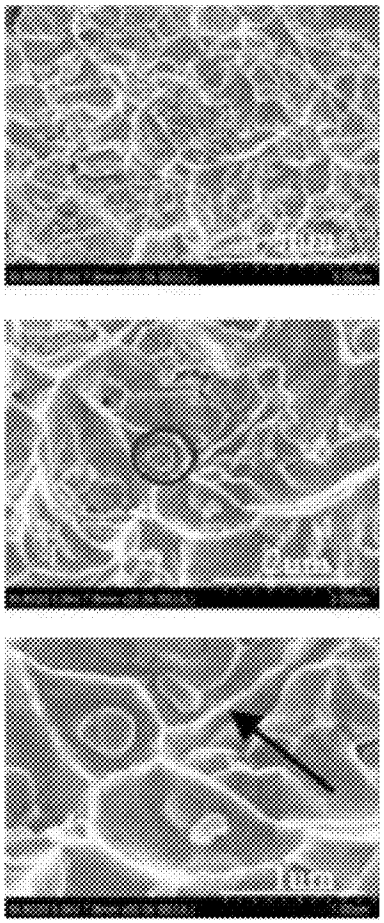
Figure 13:
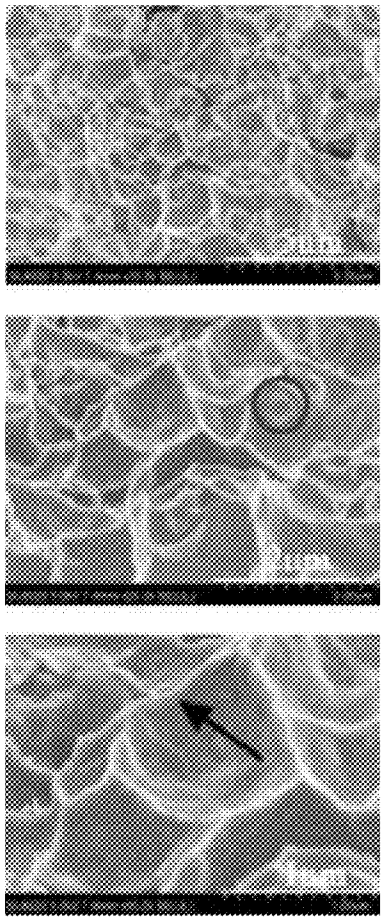

The contact samples were mechanically sheared. The purpose of fracturing the contacts was to analyze the primary structure difference between materials. The fractography of three composite materials were characterized by SEM, as shown in FIGS. 11-13, which depict with three different scales, 5 μm, 2 μm, and 1 μm. The structure of fracture image of AgW50 in FIG. 11 depicts tungsten in a 3-D silver matrix after sintered and it appears brittle with long sharp edges. Silver-graphene tungsten does not exhibit the sharp cliffs images as AgW50. In FIGS. 12 to 13, the graphene is characterized by the noticeable dimples which are formed like chiffon sheets. The arrows point the fractured 2-D graphene chiffon while silver particles are coated on chiffon. The tungsten granular are nested on the dimples of 2-D silver matrix.

The structure of silver-graphene tungsten may explain its higher strength. It could explain how silver-graphene tungsten is being reinforced. The red circles indicate how the tungsten particles nest in the dimples.

Figure 14:
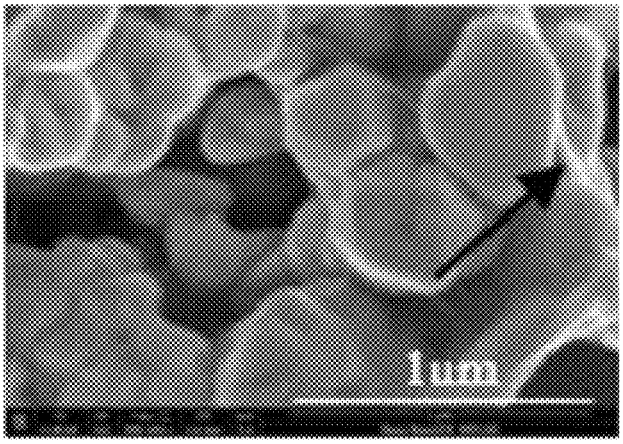
FIGS. 14-16 display higher resolution SEM images of silver graphene and its similarity in structure compared to when mixed with tungsten in accordance with an exemplary embodiment of the present invention.
Figure 15:
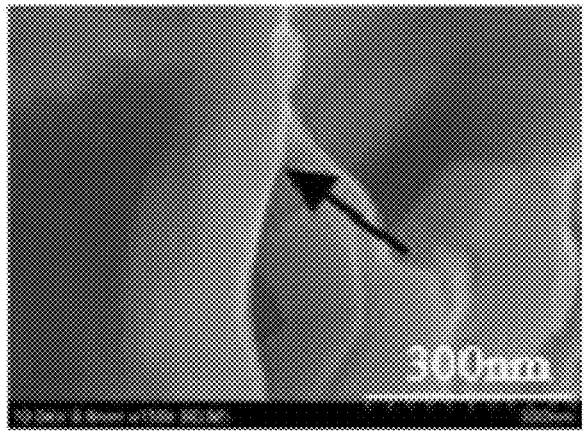
Figure 16:
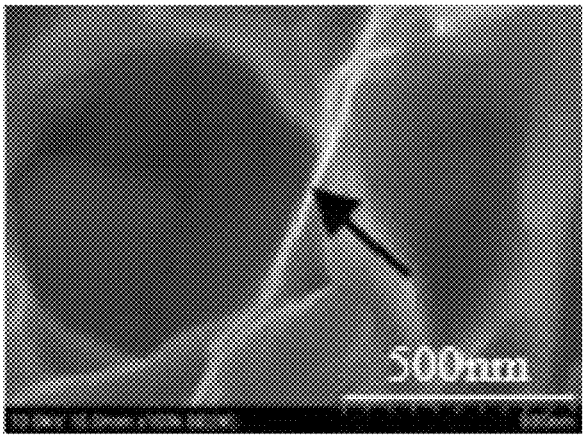

FIGS. 14-16 display higher resolution SEM images of silver graphene and its similarity in structure compared to the mix with tungsten. It is important to emphasize the inherent characteristics of graphene 2-D structure pointed by arrows in FIG. 14 does not only appear in silver-graphene but also inherited to silver-graphene tungsten (AgGr0.3W50 and AgGr0.5W50) composite material as shown in FIGS. 15 and 16.

Figure 17:
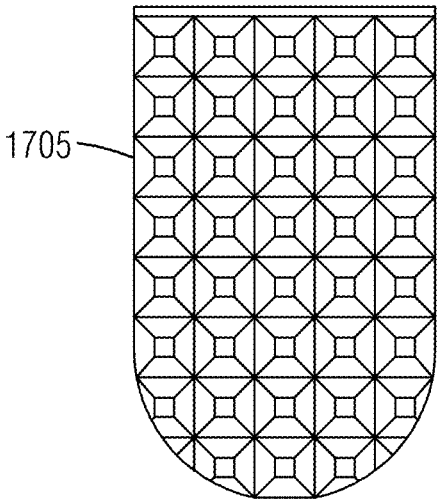
FIG. 17 illustrates a back view of a stationary contact in accordance with an exemplary embodiment of the present invention.
Figure 18:
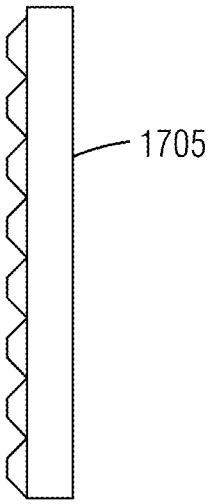
FIG. 18 illustrates a side view of the stationary contact of FIG. 17 in accordance with an exemplary embodiment of the present invention.
Figure 19:
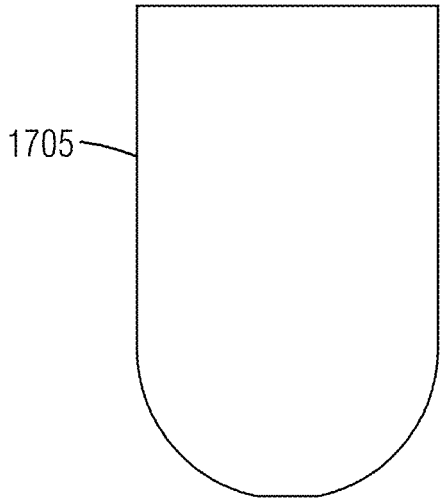
FIG. 19 illustrates a front view of the stationary contact of FIG. 17 in accordance with an exemplary embodiment of the present invention.

FIG. 17 illustrates a back view of a stationary contact 1705 in accordance with an exemplary embodiment of the present invention. FIG. 18 illustrates a side view of the stationary contact 1705 of FIG. 17 in accordance with an exemplary embodiment of the present invention. FIG. 19 illustrates a front view of the stationary contact 1705 of FIG. 17 in accordance with an exemplary embodiment of the present invention.

Figure 20:
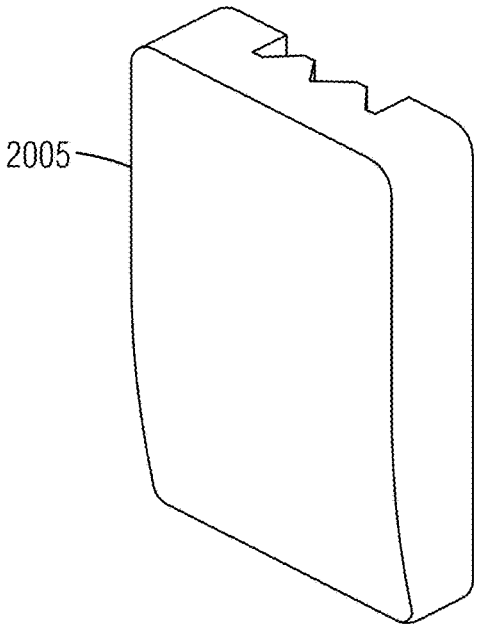
FIG. 20 illustrates a front view of a movable contact in accordance with an exemplary embodiment of the present invention.
Figure 21:
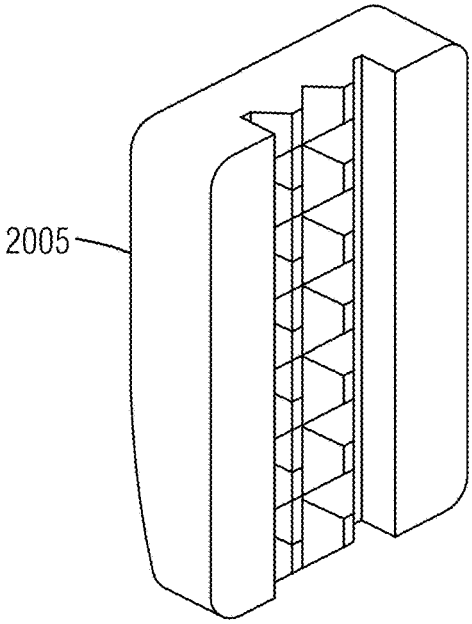
FIG. 21 illustrates a back view of the movable contact of FIG. 17 in accordance with an exemplary embodiment of the present invention.
Figure 22:
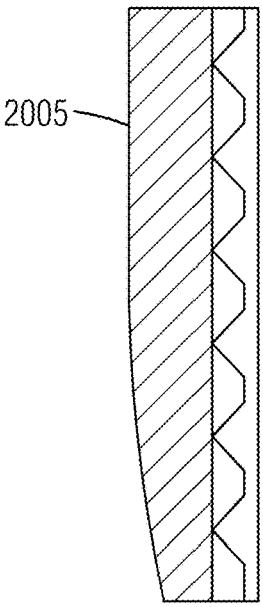
FIG. 22 illustrates a cross-sectional view of the movable contact of FIG. 20 in accordance with an exemplary embodiment of the present invention.

FIG. 20 illustrates a front view of a movable contact 2005 in accordance with an exemplary embodiment of the present invention. FIG. 21 illustrates a back view of the movable contact 2005 of FIG. 17 in accordance with an exemplary embodiment of the present invention. FIG. 22 illustrates a cross-sectional view of the movable contact 2005 of FIG. 20 in accordance with an exemplary embodiment of the present invention.

Figure 23:
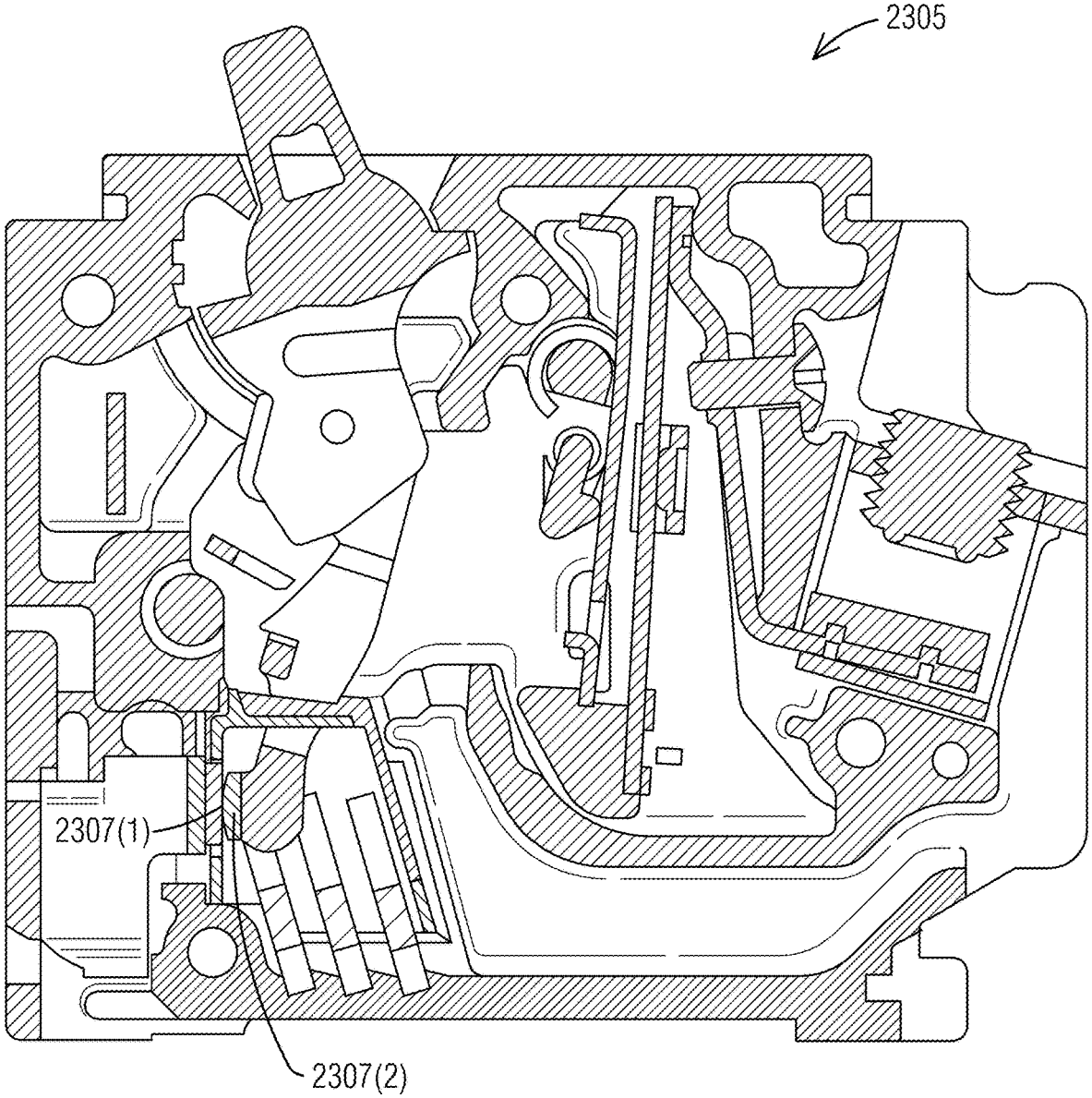
FIG. 23 illustrates a cut view of a circuit breaker in accordance with an exemplary embodiment of the present invention.

FIG. 23 illustrates a cut view of a circuit breaker 2305 in accordance with an exemplary embodiment of the present invention. The circuit breaker 2305 comprises a first contact tip 2307(1) comprising a first electrical contact material comprising silver (Ag) and tungsten (W) and a first graphene material (Gr) having a range of 0.3% to 0.5% additively mixed in Ag with silver to form (AgGr)50W50 called a first silver-graphene tungsten composite material. The circuit breaker 2305 further comprises a second contact tip 2307(2) comprising a second electrical contact material comprising silver (Ag) and tungsten (W) and a second graphene material (Gr) having a range of 0.3% to 0.5% additively mixed in Ag with silver to form (AgGr)50W50 called a second silver-graphene tungsten composite material.

A unique 2-D graphene structure has been inherited by a first silver-graphene composite material (AgGr) and a second silver-graphene composite material (AgGr). A (AgGr) 50W50 microstructure has uniform mixing while tungsten (W) distributes in a silver-graphene matrix. The first contact tip 2307(1) and the second contact tip 2307(2) are produced utilizing a PM process (press, sinter, and re-press). A (AgGr) 50W50 based contact tip structure exhibited a total mass loss of 3.8% in a testing process. The arcing energy was reduced by 27.1% and 7.4% when testing at 5 kA and 65 kA respectively in a functional testing process.

While silver-graphene tungsten is described here a range of one or more other composite materials are also contemplated by the present invention. For example, other popular composite materials, such as AgWC, AgC, CdO, $SnO_2$, and NiO with graphene additive may be implemented based on one or more features presented above without deviating from the spirit of the present invention.

The techniques described herein can be particularly useful for AgGr0.3W50 and AgGr0.5W50. While particular embodiments are described in terms of AgGr0.3W50 and AgGr0.5W50, the techniques described herein are not limited to such a 0.3% or 0.5% but can also be used with other graphene percentages.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A contact tip of a circuit breaker, the contact tip comprising:

an electrical contact material comprising silver (Ag) and tungsten (W); and a graphene material (Gr) in a range of 0.1% to 1.0% additively mixed in Ag as being denoted as AgGr0.3% (Ag 99.7% and Gr0.3% in weight) which is mixed with tungsten (W) to form (AgGr0.3)W50 ((AgGr0.3)50% and W50% in weight) called a silver-graphene tungsten composite material, wherein a (AgGr)50W50 based contact tip structure exhibited a total mass loss of 3.8% in a testing process.

2. The contact tip of claim 1, wherein a unique 2-D graphene structure has been inherited by a silver-graphene composite material (AgGr) where AgGr can be replaced with different electrical contact materials such as including AgC, AgWC, AgMo, AgNi, AgCu, AgCdO, AgSnO, AgNiO, and AgZnO whereas AgW having a variation of percentages such as AgW30, AgW60, AgW75 instead of AgW50.

3. The contact tip of claim 1, wherein a (AgGr)50W50 microstructure has uniform mixing while tungsten (W) distributes in a silver-graphene matrix.

4. The contact tip of claim 1, wherein the contact tip is produced utilizing a PM process (press, sinter, and re-press).

5. The contact tip of claim 1, wherein arcing energy was reduced by 27.1% and 7.4% when testing at 5 kA and 65 kA respectively in a functional testing process.

6. A contact tip of a circuit breaker, the contact tip comprising:

an electrical contact material comprising silver (Ag) and tungsten (W); and a graphene material (Gr) in a range of 0.1% to 1.0% additively mixed in Ag as being denoted as AgGr0.5% (Ag 99.5% and Gr 0.5% in weight) which is mixed with tungsten (W) to form (AgGr0.5)W50 ((AgGr0.5) 50% and W50% in weight) called a silver-graphene tungsten composite material, wherein arcing energy was reduced by 27.1% and 7.4% when testing at 5 kA and 65 kA respectively in a functional testing process.

7. The contact tip of claim 6, wherein a unique 2-D graphene structure has been inherited by a silver-graphene composite material (AgGr) where AgGr can be replaced with different electrical contact materials such as including AgC, AgWC, AgMo, AgNi, AgCu, AgCdO, AgSnO, AgNiO, and AgZnO whereas AgW having a variation of percentages such as AgW30, AgW60, AgW75 instead of AgW50.

8. The contact tip of claim 6, wherein a (AgGr)50W50 microstructure has uniform mixing while tungsten (W) distributes in a silver-graphene matrix.

9. The contact tip of claim 6, wherein the contact tip is produced utilizing a PM process (press, sinter, and re-press).

10. The contact tip of claim 6, wherein a (AgGr)50W50 based contact tip structure exhibited a total mass loss of 3.8% in a testing process.

11. A circuit breaker, comprising:

a first contact tip comprising:

a first electrical contact material comprising silver (Ag) and tungsten (W); and a first graphene material (Gr) having a range of 0.3% to 0.5% additively mixed in Ag with silver to form (AgGr)50W50 called a first silver-graphene tungsten composite material; and a second contact tip comprising:

a second electrical contact material comprising silver (Ag) and tungsten (W); and a second graphene material (Gr) having a range of 0.3% to 0.5% additively mixed in Ag with silver to form (AgGr)50W50 called a second silver-graphene tungsten composite material, wherein a unique 2-D graphene structure has been inherited by a first silver-graphene composite material (AgGr) and a second silver-graphene composite material (AgGr).

12. The circuit breaker of claim 11, wherein a (AgGr) 50W50 microstructure has uniform mixing while tungsten (W) distributes in a silver-graphene matrix.

13. The circuit breaker of claim 11, wherein the first contact tip and the second contact tip are produced utilizing a PM process (press, sinter, and re-press).

14. The circuit breaker of claim 11, wherein a (AgGr) 50W50 based contact tip structure exhibited a total mass loss of 3.8% in a testing process.

15. The circuit breaker of claim 11, wherein arcing energy was reduced by 27.1% and 7.4% when testing at 5 kA and 65 kA respectively in a functional testing process.

* * * * *